United States Patent [19]

Pasbrig

[11] Patent Number: 4,850,316

[45] Date of Patent: Jul. 25, 1989

[54] CONTACT-BREAKING IGNITION PLUG AND METHOD OF GENERATING A SPARK THEREWITH

[75] Inventor: Max Pasbrig, Orselina, Switzerland

[73] Assignee: Lacrex Brevetti SA, Orselina, Switzerland

[21] Appl. No.: 13,730

[22] Filed: Feb. 11, 1987

[30] Foreign Application Priority Data

Feb. 18, 1986 [CH] Switzerland ..... 00639/86

[51] Int. Cl.[4] ..... F02P 15/00

[52] U.S. Cl. ..... 123/154; 123/153; 313/125; 315/57

[58] Field of Search ..... 123/154, 153, 143 R, 123/146 R; 313/125, 141; 315/51, 56, 57

[56] References Cited

U.S. PATENT DOCUMENTS

| | | | |
|---|---|---|---|
| 1,038,701 | 9/1912 | Witter | 123/154 |
| 3,693,607 | 9/1972 | Pasbrig | 123/143 R |
| 3,908,146 | 9/1975 | Pasbrig | 123/143 R |
| 4,172,439 | 10/1979 | Pasbrig | 123/143 R |
| 4,509,469 | 4/1985 | Pasbrig | 123/154 |

*Primary Examiner*—Palmer C. DeMeo
*Assistant Examiner*—Theodore Salindong
*Attorney, Agent, or Firm*—Werner W. Kleeman

[57] ABSTRACT

A contact-breaking ignition plug comprises a magnet coil arranged in a housing and surrounding a magnet core. The magnet core comprises an enlarged end portion with lateral surfaces extending conically in relation thereto and also comprises a cavity in which an armature is movably arranged. The armature is mounted on a rod in asymmetrical relation to a longitudinal center plane of the cavity and in transverse relation to the direction of compression pressure propagation. These features induce a concentration of the magnetic effect in the armature region and cause the contact-breaking motion to be augmented by the compression pressure. Respective contact electrodes are exchangeably mounted at each of the free end of the armature and a nose of the housing. The contact electrodes are mounted such that an electrical ignition pulse traversing a short-circuit path extending from the magnet coil of the electromagnet through the contact electrodes induces a magnetic field in the electromagnet, leading to interruption of the short-circuit path and the formation of a spark. The interruption sequence can be accelerated by means of this contact-breaking ignition plug and can be more precisely controlled and material deformations no longer arise during the contact-breaking motions.

11 Claims, 3 Drawing Sheets

CONTACT-BREAKING IGNITION PLUG AND METHOD OF GENERATING A SPARK THEREWITH

CROSS REFERENCE TO RELATED CASES

This application is related to my commonly assigned U.S. Pat. No. 3,693,607, granted Sept. 26, 1972, U.S. Pat. No. 3,908,146, granted Sept. 23,1975, U.S. Pat. No. 4,172,439, granted Oct. 30, 1979, and U.S. Pat. No. 4,509,469, granted Apr. 9,1985.

BACKGROUND OF THE INVENTION

The present invention broadly relates to ignition plugs and, more specifically, pertains to a new and improved construction of a break or contact-breaking ignition plug or spark plug and a method of generating an ignition spark therewith.

In its more specific apparatus aspects the present invention relates to a new and improved construction of a break or contact-breaking ignition plug or spark plug in which an electrical ignition pulse traverses a magnet coil of an electromagnet and a short-circuit path completed by a plurality of electrodes, for instance a pair of contact electrodes, such that a magnetic field arising around the electromagnet effects an opening of the electrodes and therefore an interruption of the short-circuit path as well as the formation of a spark. The contact-breaking ignition plug has an elastic or resilient rod arranged within a magnet core of the electromagnet and extending along a longitudinal axis of the contact-breaking ignition plug. An armature is fastened to the elastic rod within the magnetic field. The short-circuit path is completed by the contact electrodes in a region outside of the magnet core.

In other words, the break ignition plug of the present invention is for installation in an electrically conductive machine member and comprises a magnet core, a support rod and an armature piece. The magnet core is of magnetic material and contains a cavity or hollow space and defines a longitudinal axis of the break ignition plug. The support rod is a rod of elastically resilient and electrically conductive material anchored at a first end in the magnet core and extending substantially along the longitudinal axis of the cavity. The armature piece is of magnetic material and is attached to a second end of the support rod and preferably extends beyond the magnet core.

The method of the invention is for generating an ignition spark employing a break ignition plug and comprises the steps of transmitting an electrical ignition pulse to the break ignition plug and conducting the electrical ignition pulse through an electromagnet of the break ignition plug for establishing a magnetic field for attracting a resiliently supported armature piece of magnetic material.

Contact-breaking ignition plugs of the abovementioned type are known from German patent No. 204,545 dated Nov. 29, 1907 and the aforementioned U.S. Pat. No. 4,509,469, dated Apr. 4, 1985, in which two mutually insulated flat springs or lamellae are fixed in the gap or slot of an electromagnet. Armatures are fixed at the end of these flat springs or lamellae such that they are situated within the magnet core. The armatures possess members or legs projecting into the combustion chamber with electrode heads or contacts at their free ends. In the initially mentioned contact-breaking ignition plug, the magnet core and the mutually facing surfaces of the armatures are constructed such that when the armature strikes the magnet core, the armature members perform a rotary motion in order to effect an interruption of the electrode heads, and thus at every interruption movement the flat springs or lamellae carrying the armatures are flexed.

In the other type of contact-breaking ignition plug, the flat springs or lamellae are arranged in the magnet core such that during the interruption of the electrodes there occur at the flat springs or lamellae strong vibrations at the fixing point. The flat springs or lamellae are thus always highly stressed at the same position which leads to rapid metal fatigue and results in the metal quickly breaking.

In other known contact-breaking ignition plugs of this type, only one flat spring or lamella having an electrode is provided, but the problem is the same.

A further disadvantage consists in that, in a comparable embodiment, a friction effect occurs between the armatures and the magnet core with each interruption movement which leads to rapid wear and to an alteration of the armature throw and ignition timing point and leads to disadvantageous or undesired effects. In one such known embodiment, it is further disadvantageous that due to progressive wear of the two electrodes, the two armature plates on the flat springs touch and inhibit a separation or interruption of the electrodes. It is also disadvantageous in such contact-breaking ignition plugs that the hollow space or cavity in the lower portion of the housing is so constructed and the magnet coil together with the magnet core and the flat springs or lamellae are so arranged that overheating of the magnet coil and carbonization of the lower portion of the magnet core and of the armature can result, which is detrimental to operation.

SUMMARY OF THE INVENTION

Therefore, with the foregoing in mind, it is a primary object of the present invention to provide a new and improved construction of a contact-breaking ignition plug which does not exhibit the aforementioned drawbacks and shortcomings of the prior art constructions.

A further important object of the invention is to provide a contact-breaking ignition plug in which the magnet core, the hollow space or cavity and the armature, which is movable in a direction transverse to the longitudinal axis of the ignition plug, are constructed in a manner more capable of functioning properly and in which the interruption or contact breaking movement is capable of being carried out in a manner which is free of wear and in which overheating and carbonizing effects are reduced.

It is also an object of the invention to provide a method of generating an ignition spark employing a break ignition plug and exploiting the advantages of the inventive break ignition plug.

Now in order to implement these and still further objects of the invention, which will become more readily apparent as the description proceeds, the break or contact-breaking ignition plug of the present invention is manifested by the features that a region of increased wall thickness containing a recess is provided on the magnet core in the region of the armature and outside of the magnet coil. The armature having an electrode projects beyond the magnet core and is located at the end of the elastic rod.

In other words, the break ignition plug of the present invention is manifested by the features that it comprises a magnet coil surrounding the magnet core. First electrical conductor means are connected to the input side of the magnet coil for supplying an electrical or control pulse to the magnet coil. Second electrical means connect the output side of the magnet coil to the first end of the support rod. A mobile contact electrode is mounted in the armature piece. Electrical insulation means support the magnet core and support means support the electrical insulation means relative to the electrically conductive machine member for establishing electrical ground contact with the electrically conductive machine member. A stationary contact electrode is mounted on the support means. The armature piece has an idle position in which the mobile contact electrode completes an electrical circuit with the stationary contact electrode and a magnetically deflected position in which the electrical circuit is interrupted when the electrical ignition pulse is supplied to the magnet coil.

The method of the present invention is manifested by the features that it comprises the further steps of conducting the electrical ignition pulse from the electromagnet through an electrically conductive, elastically resilient support member and through the armature piece such that the electrical ignition pulse interacts with the magnetic field to deflect the electrically conductive armature piece relative to the magnetic field. A subsequent method step entails conducting the electrical ignition pulse from the mobile contact electrode to an electrically grounded stationary contact electrode for completing an electrical circuit and allowing the magnetic field to attract the resiliently supported armature piece and to deflect the electrically conductive, elastically resilient support member such that the mobile contact electrode is displaced away from the stationary contact electrode for interrupting the electrical circuit and thereby inducing the ignition spark.

A concentration of the magnetic effect in the region of the armature is assured due to the fact that the magnet core possesses in the region of the armature an enlargement or mushroom shaped region of increased wall thickness having conically extending lateral surfaces and containing a cavity or hollow space. Since the armature is arranged in the cavity of the magnet and asymmetrically in relation to the longitudinal plane of the cavity of the magnet core so as to be movable in a direction transverse to the direction of compression pressure propagation, the compression pressure supports or augments the contact-breaking or interruption motion. Due to the pattern of the magnetic field lines or lines of magnetic flux, a repulsion effect on the armature extending beyond the magnet core arises in supplement to the magnetic attraction effect. The interruption or contact-breaking sequence can thereby be accelerated and carried out in a more accurate manner, and furthermore, the long elastic rod substantially eliminates material deformation during the interruption or contact-breaking movement.

Because the armature is provided with a recess or pocket at the portion which projects into the combustion chamber, the movable contact electrode fixed thereto is biased or pre-loaded in the direction of interruption and the requisite magnetic force is reduced. Furthermore, with this arrangement, the armature and the contact electrodes can be easily replaced due to the fact that they protrude beyond the ignition plug housing. Due to the arrangement of the stepped or shouldered hollow space or cavity in the magnet core, carbonization or sooting of the armature is minimized and because the hollow space or cavity is provided with vents, overheating is reduced. This is especially advantageous when the contact-breaking ignition plug is not utilized in internal combustion piston prime movers but is used as an ignitor or detonator.

If there is direct supply of electrical current from the ignition cable to the magnet coil and to the elastic resilient rod, then the provision of a seal in the upper portion of the contact-breaking ignition plug can be dispensed with, permitting a more compact design. The elastic or resilient rod can also be welded to the upper portion of the magnet core, in which case no seal is required for the elastic rod.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
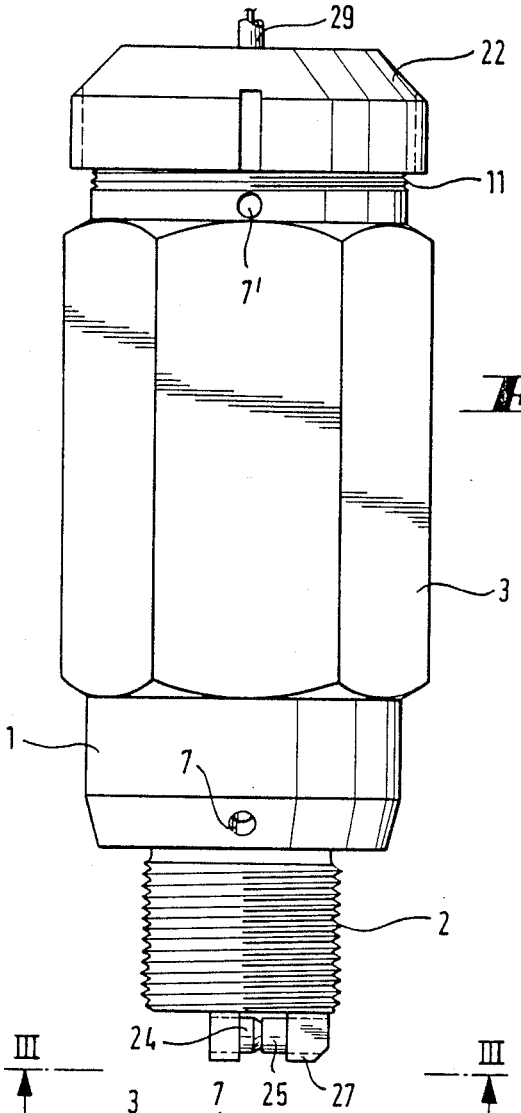
FIG. 1 shows a front view of an exemplary embodiment of a break or contact-breaking ignition plug.
Figure 3:
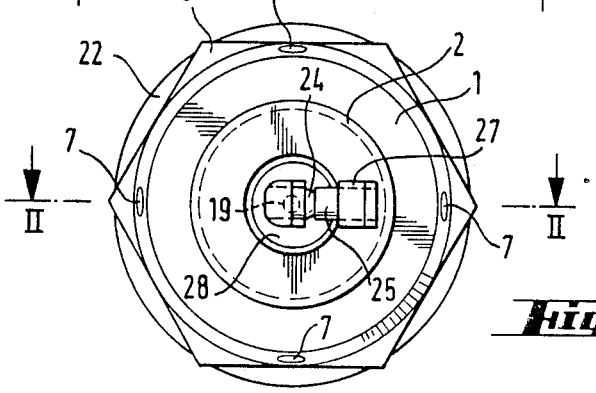
FIG. 3 shows an end view on the electrode side of the break or contact breaking plug in accordance with FIG. 1 viewed in the direction of the line III—III thereof.
Figure 2:
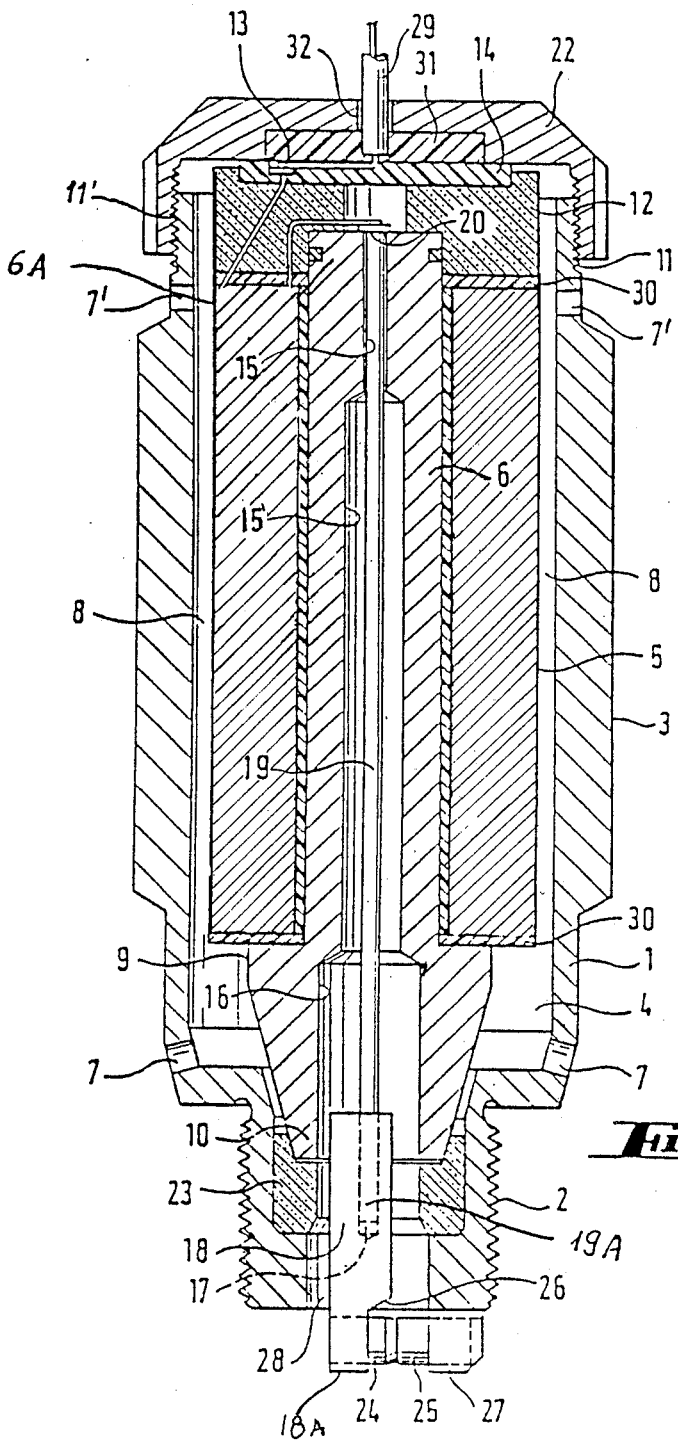
FIG. 2 shows a longitudinal sectional view of the break or contact-breaking ignition plug depicted in with FIG. 1 taken along the line II—II of FIG. 3.

Describing now the drawings, it is to be understood that to simplify the showing thereof, only enough of the structure of the break ignition plug or contact-breaking ignition plug has been illustrated therein as is needed to enable one skilled in the art to readily understand the underlying principles and concepts of the present invention. Turning now specifically to FIG. 2 of the drawings, the break or contact-breaking ignition plug illustrated therein by way of example and not limitation will be seen to comprise a substantially cylindrical contact-breaking ignition plug housing 1 with a polygonal profile 3, for instance a hexagonal body portion, made of a suitable metallic material which, however, is non-magnetic. The housing 1 narrows or is shouldered down towards a threaded portion 2 for screwing into and establishing electrical ground contact with a here not particularly shown electrically conductive machine member, such as a cylinder head of an internal combustion engine or an ignition or detonator system. The threaded portion 2 terminates in a nose or boss or projection 27 arranged at one side for fastening a fixed or stationary contact electrode 25.

The outer surface of the housing 1 possesses vent openings or passages 7 and 7' which lead into a hollow space or cavity 4 and an annular clearance space 8. The housing 1 is provided at an end opposite to the threaded portion 2 with a thread 11 for a cap 22 having a thread 11'. In the cap 22 there is arranged a bore or hole 32 for an ignition cable 29 as well as a conductor disc 14 for an electrical connection 13 an provided with seals 31 and 12.

A magnet coil 5 constituting an electromagnet is provided with insulating plates 30 and is inserted into the hollow space or cavity 4 of the housing 1, leaving free the annular clearance space 8. Furthermore, there is inserted into the hollow space or cavity 4 and within the magnet coil 5 a magnet core 6 which is made of magnetic material and possesses in the region of an armature 18 an approximately mushroom shaped region or enlargement 9 of increased wall thickness. The mushroom shaped region 9 has a conically extending tip 10. The magnet core 6 is supported on an insulating seal 23 at the tip 10. The magnet core 6 possesses a central bore or cavity 15 of a stepped configuration containing enlargements or hollow spaces 15' and 16 formed by shoulders.

The armature 18 is made of magnetic material and extends beyond the magnet core 6 in the region of the hollow space or cavity 16 in the magnet core 6. The armature 18 possesses a blind bore 17, by means of which it is fastened to a free end 19A of a support rod 19 of electrically conductive, elastically resilient material. At its head portion or end 20, the elastic or resilient support rod 19 possesses an electrical connection and is anchored or fixed in the magnet core 6 at a head end or portion 6A thereof. The armature 18 is situated asymmetrically in relation to the longitudinal center plane of the cavity 16 and to a contiguous recess or pocket 28 of the threaded portion 2. The armature 18 is provided with a recess or step 26 in the region of the combustion chamber or the like. A movable or mobile contact or first electrode 24 is arranged in the armature 18 at a free end 18A thereof in the region of this step 26. The armature 18, the mobile contact electrode 24 and the stationary contact or second electrode 25 are arranged such that they are easily replaceable or exchangeable. The heads of the mobile and stationary contact electrodes 24 and 25 are arranged in mutual confrontation and are in mutual electrical contact in the rest or idle position of the mobile contact electrode 24.

Figure 4:
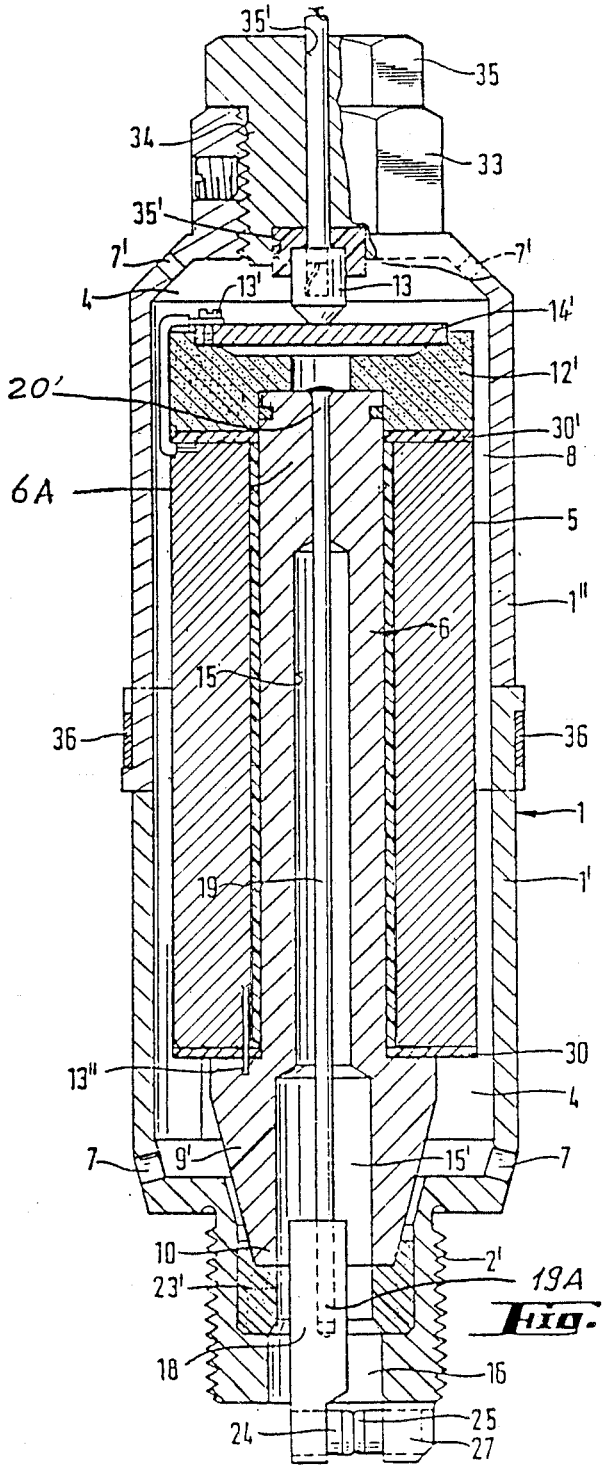
FIG. 4 illustrates in longitudinal sectional view a further embodiment of break or contact-breaking ignition plug constructed in accordance with the present invention.

FIG. 4 illustrates a further embodiment of break or contact-breaking ignition plug. This break or contact-breaking ignition plug as illustrated in FIG. 4 contains an essentially cylindrical housing 1 which is composed of a lower portion 1' equipped with air vents or openings 7 located at a region which tapers or converges towards the thread-in or threaded side of the contact-breaking ignition plug, a threaded portion 2' and a protruding nose or projection 27 provided with an electrode 25 as well as an upper portion or section 1'' having the air vents or openings 7' in a flattened part or portion thereof. At the upper free part or portion there is provided a multi-edge or polygon profile 33 having an internal thread or threading 34 for a screw or threaded bolt 35 possessing threads. This screw or threaded bolt 35 is provided at its central region with a recess or bore 35' for receiving an electrical connection 13. This electrical connection 13 is pressed by the screw or threaded bolt 35 against a disc or plate 14' formed of electrically conductive material. This conductive disc or plate 14' is arranged in the hollow space or cavity 4 of the housing 1. This conductive disc or plate 14' is provided with the seal or insulation 12' bearing upon the insulation structure or insulation plate means 30' or the magnet coil 5 surrounding the magnet core 6. The magnet core 6 possesses, as viewed in the direction of the armature, an approximately mushroom-shaped enlargement or reinforcement element 9' possessing a conically extending tip 10, a central hollow bore or space or cavity 15 with a step-shaped or stepped enlargement or widened portion 15' and a sealing ring or electrical insulation means 23'. The threaded portion 2' constitutes support means for supporting the sealing ring or electrical insulation means 23' and establishes electrical ground contact for the electrically conductive machine member which is equipped with the break or contact-breaking ignition plug. Below the sealing ring 23' there is provided a stepped or widened portion 16 defining a hollow space in the threaded portion 2'. In the hollow bore or space or cavity 15 and widened portion 15' there is arranged an elastic or resilient support rod 19 which protrudes past the magnetic core 6. The second or lower or free end 19A of the elastic or resilient support rod 19 carries the armature or armature piece 18 protruding beyond the magnet core 6 and asymmetrically secured to a second or free end 19A of the support rod 19 and in relation to the longitudinal central plane of the hollow space or cavity 16 externally of the magnet core 6. The elastic or resilient support rod 19 is pressed-into or welded or otherwise appropriately attached with its first end 20' to the upper part or head end 6A of the magnetic core 6. The arrangement is such that the magnet core 6 defines the longitudinal axis of the break ignition plug and the support rod 19 extends substantially along said longitudinal axis in the cavity 15.

The electrodes 24 and 25 which are readily exchangeable and which are respectively arranged at the armature 18 at a free end 18A thereof and at the nose or projection 27, are in contact with one another at their head portions in the rest position. The electrode or stationary contact electrode 25, which is carried by the support means or threaded portion 2', possesses a beveled or tapered portion, whereas the electrode 24 is constructed to be domed or arched. A copper wire which is covered with ceramic insulation or is eloxidized, i.e. electrolytically oxidized, is provided as the winding of the magnetic coil 5, and one end or first electrical conductor means 13' thereof is connected with the conductive disc or plate 14' on the input side and the other end or second electrical conductor means 13'' is connected with the magnetic core 6 on the output side. The housing lower portion 1' and the housing upper portion 1 '' are covered by mutually interengaging recesses or the like equipped with a securing ring 36. It is possible to dispense with the use of the insulation between the magnetic core 6 and the winding of the magnetic coil 5 if there are employed ceramic-coated or a specially eloxidized, i.e. electrolytically oxidized copper wire for the coil winding.

The mode of operation of the break or contact-breaking ignition plug is as follows:

The electrical potential of a conventional battery or other suitable power source is either transformed to a higher value or is directly supplied. Depending on the number of cylinders or apparatuses to be driven, the battery or power source is connected to an appropriate number of thyristors which, in turn, are also connected to an appropriate number of break or contact-breaking ignition plugs. A distributor or a timer with an ignition pulse generator controls the thyristors such that, depending on the desired ignition sequence, they supply control or electrical ignition pulses to the appropriate cylinders or apparatuses. The ignition current energizes the electromagnet and also flows through the electrical circuit or short-circuit path formed by the contact electrodes 24 and 25. The magnetic field which builds up generates a magnetic effect in the region of the armature 18. The shape of the mushroom shaped region 9 of the magnet core 6 ensures a concentration of this magnetic effect. Besides the magnetic pull effect or attraction on the armature 18 there is also caused a separation or repulsion effect between the magnetic core 6 and the armature 18 due to the pattern of the magnetic field lines or the lines of magnetic flux. These magnetic effects conjointly induce a motion of the armature or armature piece 18 and with it the mobile contact electrode 24 from an idle position in which the electrical circuit or short-circuit path is closed into a magnetically deflected position in which the circuit is interrupted and which is limited by the seal 23 or 23' as the case may be. When the contact electrodes 24 and 25 are separated, an ignition spark is formed and this separation also causes an interruption of the electrical circuit or short-circuit path so that the magnetic field collapses again and the contact electrodes are able to return to the contact or closed position, i.e. the idle position.

The invention is not limited to the illustrated exemplary embodiments. Since it is possible to employ break ignition plugs or contact-breaking ignition plugs for motors other than piston engines and also for other purposes, the housing of the ignition plug can have a form other than cylindrical or, as explained, can be assembled from individual components. In such case and with corresponding construction, the inner components would have to be adapted to the selected form. The contact electrodes can also be mounted differently or arranged differently. The cavities and clearance spaces can be partially or completely filled with insulating members and the vent openings renounced.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A contact-breaking ignition plug wherein an electrical ignition pulse traverses a short-circuit path and an electromagnet such that a magnetic field builds up in the electromagnet and causes an interruption of the short-circuit path for inducing an ignition spark, comprising:

a housing defining a longitudinal axis;

an electromagnet including a magnet coil arranged in said housing;

said electromagnet further including a magnet core arranged within said magnet coil;

an elastic rod arranged within said magnet core along said longitudinal axis;

an armature fixed to said elastic rod and located within a magnetic field of the electromagnet;

first and second electrodes arranged outside said magnet core and forming a portion of the short-circuit path;

said magnet core at a location outside said magnet coil having an enlargement containing a cavity accommodating said armature;

said first electrode in conjunction with said armature being magnetically deflected in substantially transverse direction relative to said longitudinal axis of said housing in response to the electrical ignition pulse for interrupting said portion of said short-circuit path; and said elastic rod being connected with said armature carrying said first electrode at a location outside of said magnet core.

2. The contact-breaking ignition plug as defined in claim 1, wherein:

said magnet core has a head end; and said elastic rod having an end fixed in said head end of said magnet core.

3. The contact-breaking ignition plug as defined in claim 2, wherein:

said elastic rod has a free end opposite said fixed end;

said cavity of said enlargement of said magnet core having a longitudinal center plane; and said armature being arranged at said free end of said elastic rod in asymmetrical relation to said longitudinal center plane of said cavity.

4. The contact-breaking ignition plug as defined in claim 2, wherein :

said armature has a free end opposite said fixed end of said elastic rod;

said armature having a recess; and said recess and said first electrode being arranged at said free end of said armature.

5. The contact-breaking ignition plug as defined in claim 1, wherein:

said armature, said first electrode and said second electrode are structured as replaceable parts.

6. The contact-breaking ignition plug as defined in claim 1, wherein:

said magnet core has a bore for receiving said elastic rod; and said bore having a stepped configuration.

7. The contact-breaking ignition plug as defined in claim 1, wherein:

said housing contains a cavity;

said armature is capable of performing a motion for effecting interruption of the short-circuit; and a seal for limiting said motion of said armature and for insulating said magnet core and for sealing said cavity.

8. The contact-breaking ignition plug as defined in claim 1, wherein:

said housing contains a cavity providing a clearance space between said housing and said magnet coil; and said housing being provided with vent openings for venting said clearance space and said cavity.

9. A break ignition plug for installation in an electrically conductive machine member, comprising:

a magnet core of magnetic material containing a cavity and defining a longitudinal axis of the break ignition plug;

an elastic support rod having a first end and a second end;

said elastic support rod being formed of resilient and electrically conductive material and being anchored at said first end in said magnet core and extending substantially along said longitudinal axis in said cavity;

an armature piece of magnetic material attached to said second end of said elastic support rod and extending externally of said magnet core;

a magnet coil surrounding said magnet core;

said magnet coil having an input side and an output side;

first electrical conductor means connected to said input side of said magnet coil for supplying an electrical ignition pulse to said magnet coil;

second electrical conductor means connecting said output side of said magnet coil to said elastic support rod;

a mobile contact electrode carried by said armature piece;

said armature piece, in response to said electrical ignition pulse, conjointly with said mobile contact electrode carried by said armature piece, being magnetically deflected in a direction substantially transverse to said longitudinal axis of the break ignition plug;

electrical insulation means;

support means for supporting said electrical insulation means relative to the electrically conductive machine member and for establishing electrical ground contact with the electrically conductive machine member;

a stationary contact electrode carried by said support means; and said armature piece having an idle position in which said mobile contact electrode completes an electrical circuit with said stationary contact electrode and a magnetically deflected position in which said electrical circuit is interrupted when said electrical ignition pulse is supplied to said magnet coil.

10. The break ignition plug as defined in claim 9, wherein:

said armature piece is attached to said second end of said support rod in asymmetrical relationship to said support rod.

11. A method of generating an ignition spark with a break ignition plug having a longitudinal axis, comprising the steps of:

transmitting an electrical ignition pulse to the break ignition plug;

conducting the electrical ignition pulse through an electromagnet of the break ignition plug for establishing a magnetic field for attracting a resiliently supported armature piece of magnetic material;

conducting said electrical ignition pulse from said electromagnet through an electrically conductive resilient support member and through said armature piece and thereby magnetically deflecting said armature piece substantially transversely to the longitudinal axis of the break ignition plug and the direction of compression pressure acting upon the break ignition plug;

conducting said electrical ignition pulse from a mobile contact electrode supported by said armature piece to an electrically grounded stationary contact electrode for completing an electrical circuit; and during said step of magnetically deflecting said armature piece, deflecting conjointly therewith said mobile contact electrode in a direction transverse to said longitudinal axis of the break ignition plug and said direction of compression pressure such that said mobile contact electrode is displaced away from said stationary contact electrode for interrupting said electrical circuit and thereby inducing the ignition spark.

* * * * *

UNITED STATES PATENT AND TRADEMARK OFFICE

CERTIFICATE OF CORRECTION

PATENT NO. : 4,850,316

DATED : July 25, 1989

INVENTOR(S) : MAX PASBRIG

It is certified that error appears in the above-identified patent and that said Letters Patent is hereby corrected as shown below:

Column 5, line 3, please delete "an" and insert --and--

Column 6, line 38, after "electrode" please insert --or mobile contact electrode--

Signed and Sealed this

Twelfth Day of June, 1990

*Attest:*

HARRY F. MANBECK, JR.

*Attesting Officer*

*Commissioner of Patents and Trademarks*